US009266698B2

(12) United States Patent
Sheehy et al.

(10) Patent No.: US 9,266,698 B2
(45) Date of Patent: Feb. 23, 2016

(54) PACKAGE FOR MONOFILAMENT LINE WITH EMBEDDED CUTTING TOOL AND RELATED METHOD

(71) Applicant: Shakespeare Company, LLC, Columbia, SC (US)

(72) Inventors: Brian Sheehy, Columbia, SC (US); Kelly Ross Ackley, Lexington, SC (US)

(73) Assignee: Shakespeare Company, LLC, Columbia, SC (US)

( * ) Notice: Subject to any disclaimer, the term of this patent is extended or adjusted under 35 U.S.C. 154(b) by 376 days.

(21) Appl. No.: 13/650,191

(22) Filed: Oct. 12, 2012

(65) Prior Publication Data

US 2013/0092584 A1 Apr. 18, 2013

Related U.S. Application Data

(60) Provisional application No. 61/546,226, filed on Oct. 12, 2011.

(51) Int. Cl.

| | |
|---|---|
| ***B65D 83/00*** | (2006.01) |
| ***B65D 25/20*** | (2006.01) |
| ***B65D 85/04*** | (2006.01) |
| ***B65H 75/32*** | (2006.01) |
| ***B65H 49/20*** | (2006.01) |

(52) U.S. Cl.

CPC ..... *B65H 75/32* (2013.01); *B65H 49/205* (2013.01)

(58) Field of Classification Search

CPC ..... B26B 3/00; B65H 75/32; B65H 49/205; B65H 2701/354; B65H 49/08; B65D 85/04; G07F 11/68; G07F 11/66

USPC ..... 83/13, 17, 18, 19; 30/289, 294, 282, 30/280, 286, 124, 114, 127, 278, 120.1, 30/315, 115, 27, 3; 206/403; 112/289, 112/295, 299, 292, 298; 221/1, 26, 282; 7/106; 43/44.98; 242/426, 598.6; 225/46

See application file for complete search history.

(56) References Cited

U.S. PATENT DOCUMENTS

| | | | | |
|---|---|---|---|---|
| 1,050,118 | A * | 1/1913 | Farrell | 225/51 |
| 2,653,776 | A * | 9/1953 | Rochow | 225/19 |
| 3,313,194 | A | 10/1965 | Hanscom | |
| 3,246,814 | A | 4/1966 | Lovell | |
| 4,111,089 | A | 9/1978 | Montaruli | |
| 4,637,516 | A | 1/1987 | de Roure | |
| 5,022,577 | A * | 6/1991 | Fike | 225/47 |
| 6,594,972 | B1 | 7/2003 | Fogle | |

(Continued)

FOREIGN PATENT DOCUMENTS

| | | |
|---|---|---|
| DE | 3322953 | 1/1985 |

*Primary Examiner* — Ghassem Alie

(57) ABSTRACT

A package for storing a roll of monofilament line with a cutting tool embedded in the package and a related method. The package is formed from two opposing clamshell portions made from sheets of film and pivotally connected together. A chamber is formed when the two clamshell portions are sealed together to store the roll of monofilament line. An aperture in one of the clamshell portions allows a length of monofilament line to be dispensed from within the chamber. A cutting tool is at least partially disposed between the two clamshell portions or inserted into a pocket in one of the clamshell portions when sealed together to attach the cutting tool to the package. At least a portion of the cutting tool is accessible from outside the package for cutting a length of monofilament line being dispensed from the package.

2 Claims, 7 Drawing Sheets

(56) References Cited

U.S. PATENT DOCUMENTS

| | | | | |
|---|---|---|---|---|
| 6,615,495 | B1 * | 9/2003 | Evens et al. | 30/289 |
| 7,007,442 | B1 | 3/2006 | Fogle | |
| 7,305,910 | B1 | 12/2007 | Bermes | |
| 7,665,600 | B1 | 2/2010 | Griffin | |
| 7,908,953 | B2 * | 3/2011 | Yarborough et al. | 83/607 |
| 2008/0116218 | A1 | 5/2008 | Iacona | |

* cited by examiner

PACKAGE FOR MONOFILAMENT LINE WITH EMBEDDED CUTTING TOOL AND RELATED METHOD

CROSS-REFERENCE TO RELATED APPLICATION

The present application claims priority to U.S. Provisional Patent Application No. 61/546,226 filed Oct. 12, 2011, entitled "Package With Cutter Held in Package".

FIELD OF THE INVENTION

The invention relates to packaging monofilament line. More particularly, the invention relates to a package for a roll of monofilament line with a cutting tool embedded in the package for cutting monofilament line being dispensed from the package.

BACKGROUND OF THE INVENTION

Monofilament lines are well known in the art and are commonly defined as strings made from a single fiber. Common examples of monofilament lines include, but are not limited to, vegetation trimmer or cutting lines, pulling lines, fishing lines, and utility lines. Such monofilament lines may be made from single component filaments or from multi-component filaments, and may be produced by any of a variety of methods known in the art, including, but not limited to, molding, extruding and/or spinning. Many types of monofilament lines are made from polymeric materials.

Typically, such monofilament lines are packaged in bulk form. That is, typically, the monofilament lines are produced as continuous lines of a single or multi-component filament that are wound or otherwise placed into containers for holding the monofilament lines. One such plastic container or package commonly used for vegetation trimmer line or weed cutting line is known in the industry as a "donut package" due to the general appearance of the monofilament line that is wound within the cavity of the container. The cavity of the package, as well as the monofilament line wound within it, resembles the shape of a donut.

Heretofore, users of flexible wound monofilament line packaged in plastic containers have had to use auxiliary cutting devices such as, for example, knives, scissors, blades, or wire cutters, to cut the line to a desired length. The reliance on such auxiliary cutting devices is undesirable since the user, first, must possess a cutting device suitable for and capable of cutting the monofilament line and, second, must keep the cutting device close at hand or within the proximity of the user to enable the user to cut the line at a time of convenience when needed. In addition, many cutting devices, such as knives or blades, are known to be dangerous to the user due to the exposed sharp edges of these devices.

It is known in the art to attach a monofilament line cutting tool to the container holding the monofilament line to address the foregoing problem. For example, in U.S. Pat. No. 7,908,953 a cutting tool for cutting monofilament line is attached to the package. The cutting tool comprises a base member having a groove adapted to receive the flexible line when the cutting tool is in use and a blade recessed within the groove, the blade being adapted to cut the flexible line when the line is forced into the blade during use of the cutting tool. The cutting tool further includes an arm member in operative relationship with and complementary to the base member, which arm member is capable of producing and applying mechanical advantage in a manner that forces the flexible line received within the groove against the blade to thereby sever the flexible line.

One drawback to attaching the cutting tool to the package not addressed in the '953 patent is that the cutting tool being attached to the exterior of the package lends to the cutting tool being pilfered or easily removed from the exterior of the package at the point of sale. Additionally, if the cutting tool is not attached securely to the package over time the cutting tool may loosen and fall off the package. As such, there is a need for a means for securely attaching the cutting tool to the package that is theft-proof, reliable and easy to manufacture.

SUMMARY OF THE INVENTION

In an embodiment, there is provided a package for storing a roll of monofilament line and dispensing a length of monofilament line from the package in combination with a cutting tool embedded in the package for cutting the length of monofilament line from the roll, including a package formed from two opposing clamshell portions made from sheets of film, a recess formed in each of the clamshell portions that collectively form a chamber when said two clamshell portions are in a closed configuration, the chamber configured to store said roll and allow a length of monofilament line to unwind from the roll during dispensing, and a cutting tool at least partially disposed between the two clamshell portions when in the closed configuration configured to attach the cutting tool to the package, wherein at least a portion of the cutting tool is accessible from outside the package for cutting a length of monofilament line being dispensed from the package.

In an embodiment, there is provided a package for storing a roll of monofilament line and dispensing a length of monofilament line from the package in combination with a cutting tool embedded in the package for cutting the length of monofilament line from the roll, including a package formed from two opposing clamshell portions made from sheets of film and pivotally connected together, the two clamshell portions being pivotal between open and closed configurations, a recess formed in each of the clamshell portions that collectively form a chamber when the two clamshell portions are in the closed configuration, the chamber configured to store and allow a length of monofilament line from the roll, and a cutting tool disposed in a second pocket formed in one of the clamshell portions, the cutting tool including a body portion that is completely contained in the pocket and a cavity in the main body having a slotted opening, wherein the slotted opening is aligned with a complementary slotted opening formed in the opposing clamshell portion, wherein the monofilament line is inserted through the opening in the clamshell portion into the cavity and urged against a blade disposed in the cavity to cut the length of monofilament line being dispensed from the roll in the chamber of the package In an embodiment, there is provided a cutting device for cutting a length of monofilament line from a roll of monofilament line line stored in a package, including a body portion that protrudes through an opening in one of two clamshell portions forming the package such that a blade portion disposed on the body portion is exterior to the package, a base portion sandwiched between the two clamshell portions when the clamshell portions are sealed together, and a slotted cavity formed on the main body and disposed exterior of and accessible only from the exterior of the the package, wherein a length of monofilament line is inserted into the cavity and pressed against a blade in the cavity to cut the length of the monofilament line being dispensed from the roll stored in the package.

In an embodiment, there is provided a method of dispensing and cutting a length of monofilament line from a package storing the monofilament line, including the steps of: advancing a length of monofilament line from a roll of monofilament line stored in a compartment formed in the packaged, inserting the monofilament line in the region where the monofilament line is to be cut through a first sidewall of the package into a cavity of a cutting device disposed in a pocket formed in a second opposing sidewall of the package, urging the monofilament line against a blade disposed in the cavity to cut the length of monofilament line from the roll, and removing newly cut ends of the length of monofilament line and the roll of monofilament line from the cavity of the cutting device and back through the opening formed in the first sidewall.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
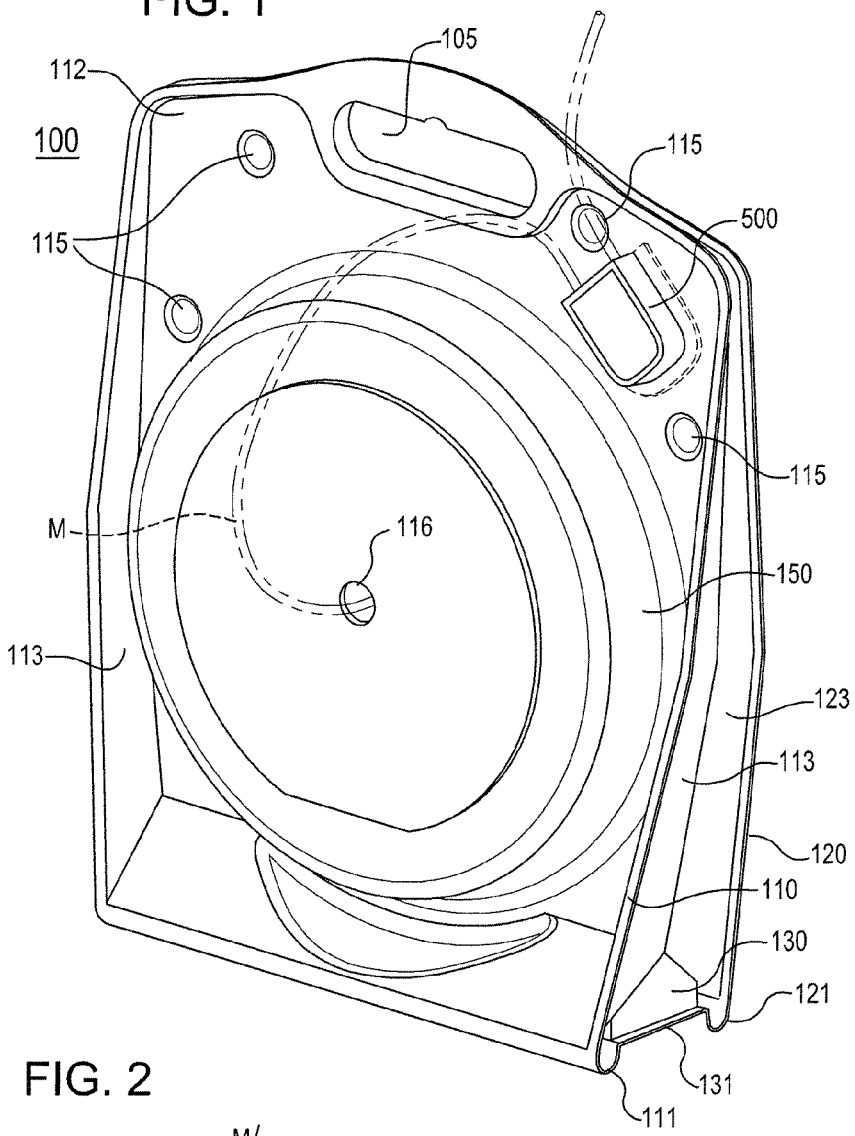
FIG. 1 is a perspective view of an embodiment of a package for monofilament line having an embedded cutting tool.

Referring now to the drawing figures in which like reference designators refer to like elements, there is shown in FIG. 1 an exemplary embodiment of a package 100 for storing a spool of monofilament line and dispensing the monofilament line therefrom. In the illustrated embodiment, the package 100 is shown as a plastic, thermoformed container commonly referred to in the monofilament line industry as a "donut package" inasmuch as the cavity 150 storing the monofilament line within the package 100 is said to resemble a donut. The package 100 is made from transparent plastic thereby allowing the spool of monofilament line to be viewed. It is to be appreciated that a variety of known plastics may be utilized to thermoform the package 100 or housing of the present disclosure including but not limited to Polyethylene (PE), Polypropylene (PP), Polystyrene (PS), High impact polystyrene (HIPS), Acrylonitrile butadiene styrene (ABS), Polyethylene terephthalate (PET), recycled Polyethylene terephthalate (RPET), copolymers of Polyethylene terephthalate such as PETG, Poly(vinyl chloride) (PVC); Polyurethanes (PU) and Polycarbonate (PC). Some of the above plastics can also be blow molded or thermoformed into a suitable package.

In an embodiment, the package 100 may be made of one-piece (clamshell) or two-piece construction, wherein the package 100 includes opposed clamshell portions 110 and 120 that generally form a housing or container defining a cavity 150 for storing flexible wound line M. The opposed clamshell portions 110 and 120 may be thermoformed and cut from pieces of material, or otherwise molded from the same mold and, thereby have the same identical shape and size, or may be cut, molded or thermoformed from different molds and, thereby, not have the same identical shape or size.

In an embodiment, the opposed clamshell portions 110 and 120 may be pivotally attached to a base 130 made from the same or a different material. The opposed clamshell portions 110 and 120 may be integrally molded with the base 130, or if formed as separate pieces, attached to the base 130 using glue, thermal fusing, or other attachments means. The base 130 may have a flat bottom surface 131 that may be positioned on a horizontal surface for supporting the package 100 in a vertical position as illustrated in FIG. 1. Adjacent to the flat surface 131 are folds 111 and 121 that connect the clamshell portions 110 and 120 to the base 130.

The opposed clamshell portions 110 and 120 (reference may be made to FIG. 11 hereinafter which illustrates a package 200 nearly identical to the one shown in FIG. 1 but illustrates the otherwise identical features of package 100 with more clarity) may be different such that one of the clamshell portion 110 is thermoformed, cut or molded with a substantially flat outer planar wall 112 with a outwardly facing recess 114 radially extending from its center partially forming the cavity 150, while the other clamshell portion 120 is thermoformed, cut or molded with a substantially flat outer planar wall 122 with a outwardly facing recess 124 radially extending from its center partially forming the cavity 150. The recesses 114 and 124 collectively form the cavity 150 when the clamshell portions 110 and 120 are in the sealed or closed configuration as shown in FIG. 1. An opening 116 is formed in the center of the recess 114 for allowing the monofilament line M to be dispensed from within the cavity 150. The base 130 may be triangular shaped so that tapered walls 117 of the clamshell portions 110 and 127 of the clamshell portion 120 mate with the respective tapered portions 130*a*, 130*b* allowing the clamshell portions 110, 120 to fold compactly into each other and then be sealed together as shown in FIG. 1. The clamshell portions 110 and 120 may include orthogonal lips 113 and 123 along the side edges for giving the clamshell portions 110 and 120 rigidity in the planar direction.

In an embodiment, the opposed clamshell portions 110 and 120 may be affixed or sealed together above the cavity 150 using a plurality of reversible snap-type fasteners 115 or other fastening means including adhesives. The snap-type fasteners 115 illustrated are formed from a projection 115*a* in the sidewall 112 that snaps into a complementary dimple 115*b* formed on the sidewall 122. The reversible snap-type fasteners 115 are disposed above the cavity 150 and spaced to provide maximum sealing effectiveness of the opposing clamshell portions 110 and 120, and yet the consumer can disassemble the package for ease of recycling after using the monofilament line. A looped handle 105 may be formed in the top of the opposing clamshell portions 110 and 120 for transporting the package 100 or hanging it on a display rack in a retail store, etc. The looped handle 105 is formed from cutouts 105*a* in the clamshell portion 110 and 105*b* in the clamshell portion 120 (see FIG. 11).

It will be appreciated, however, that other forms of packages or containers may be used in conjunction with the concepts of the present invention, and the present invention should not be limited to the embodiments described herein and illustrated in the drawings, the breadth of the invention being determined by the scope and spirit of the attached claims. For example, the package 100 may alternatively be cut, extruded, molded, blow molded, injection molded or thermoformed into any desired container shape or size known in the art. The package 100 may be made from hard plastic, thin plastic, thermoformed plastic, molded plastic, cut plastic, paper, cardboard or even may be made from metal or aluminum or combinations of any of these. Still further, the package 100 may be made so that the monofilament line M contained therein is wound onto a spool, or may be made such that no spool is necessary for the wound line. Alternatively, the package 100 may be made as a loop package. Loop packages typically contain 3 to 50 feet of line. In contrast, spools may be used to hold up to 5 pounds of line. Essentially any size or shape container will be suitable as the package 100 provided it can contain and store flexible wound line M as shown in the drawings. However, in one embodiment, the package 100 is made of non-metal. In another embodiment, the package 100 is made solely of polymeric materials.

Flexible wound line M may be essentially any line known in the art, including but not limited to, vegetation trimmer or cutting line, fishing line, pulling line, utility line, and the like. While it is preferably monofilament line, it will be appreciated that multi-filament lines, e.g., yarns, ropes, etc., may also be included as flexible wound line. Similarly, while the line is preferably polymeric, it will be appreciated that line made from non-polymeric materials, e.g., wire, cable, etc., may also be included as flexible wound line. Still further, tubing or other continuous filaments having a hollow core may also be included as flexible wound line for the purposes of this invention. However, in one embodiment, the present invention is a package 100 containing a flexible wound line that is devoid of filaments having hollow cores. In another embodiment, the present invention is a package 100 containing flexible wound line that is devoid of multi-filaments. And in yet another embodiment, the present invention is a package 100 containing polymeric flexible wound line.

Figure 2:
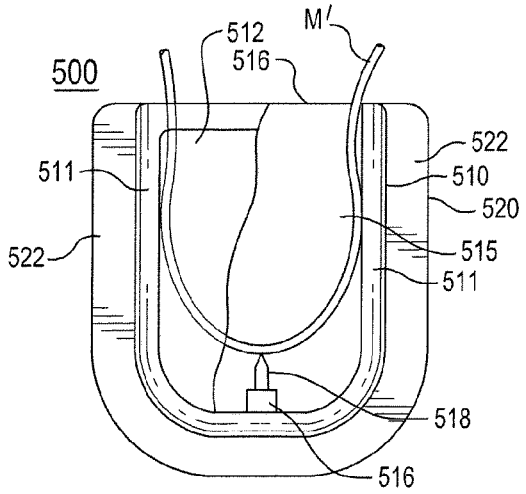
FIG. 2 is a partial cutaway front view of the cutting tool of FIG. 1.

Referring now also to FIG. 2, a cutting tool 500 is embedded in the package 100. By the term "embedded," it is meant that the cutting tool 500 is attached to the package 100 in some manner such that at least a portion of the cutting tool 500 is disposed in the interior of the package 100 and not merely mounted on the exterior of the package 100. The cutting tool 500 is of the type where a looped portion M' of the monofilament line M is inserted into a U-shaped cavity 515 foil led in the housing 510. The housing 510 is generally U-shaped and has a U-shaped sidewall 511 partially forming the cavity 515. A planar sidewall 512 encases the sidewall 511 on one side and a planar base 522 encases the sidewall 511 on an opposing side. The base 520 has overlapping edges 522 for the purposes described below. A cutting blade 518 sits atop a centrally positioned projection 516 for cutting the monofilament line M when inserted into the cavity 515 as shown in FIG. 1. The cutting tool 500 may be made from any material known in the art. In one embodiment, the cutting tool 500 is made entirely of plastic. In another embodiment, the cutting tool 500 is molded entirely of plastic except for the blade 518. In yet another embodiment, the cutting tool 500 is molded from a combination of materials, including plastic, metal and aluminum. A more detailed description of the cutting tool 500 and its operation may be found in U.S. Pat. No. 7,305,910, which is hereby incorporated by reference as if fully rewritten herein.

Figure 3:
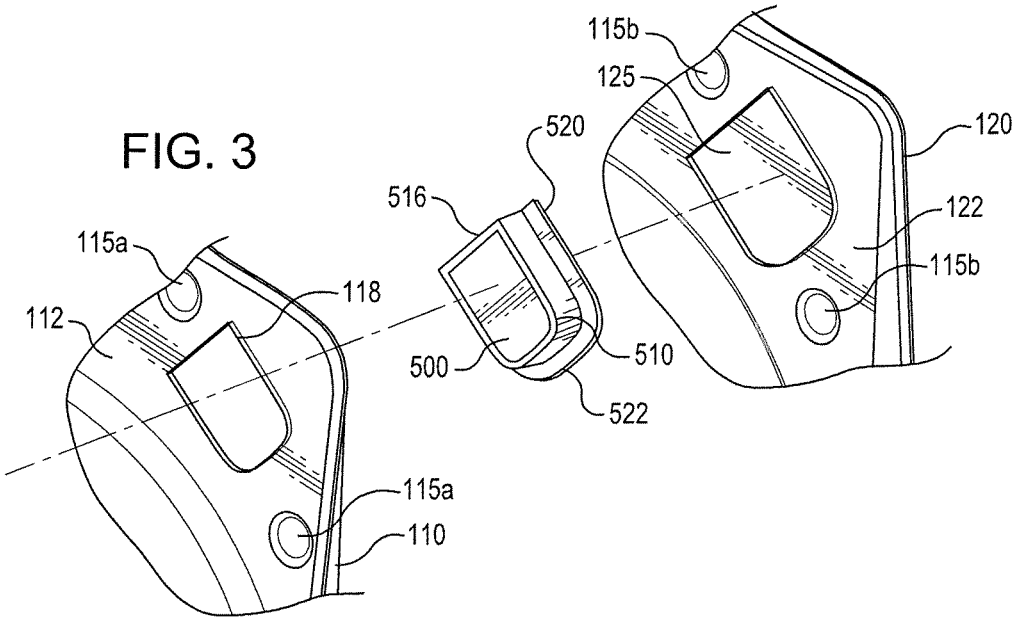
FIG. 3 is an exploded perspective view of partial cutaway portions of two clamshell portions that form the package of FIG. 1 and the cutting tool sandwiched between the clamshell portions.
Figure 4:
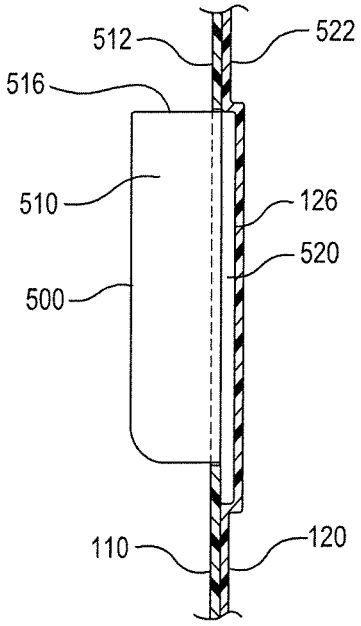
FIG. 4 is a side view of a cutaway cross-section of a portion of the package of FIG. 1 in the vicinity of the cutting tool showing the cutting tool embedded between clamshell portions forming the package.

Referring now to FIGS. 3 and 4, the cutting tool 500 is mounted to the package 100 by being sandwiched between the sidewall 112 of clamshell portion 110 and the sidewall 122 of the clamshell portion 120. The housing 510 of the cutting tool 500 is inserted into an opening 118 in the sidewall 112 for securing the cutting tool 500 to the sidewall 112 while allowing the housing 510 to be exposed on the exterior of the sidewall 112. The opposing clamshell portion 120 has a recess 125 formed in the sidewall 122 sized and shaped to receive the base 520 of the cutting tool 500 when the opposing clamshell portions 110 and 120 are in the sealed or closed configuration shown in FIG. 1. An adhesive may be used to facilitate adhering the base 520 to the recess 125. A pair of projections 115*a*, 115*a* on the sidewall 112 of the clamshell portion 110 near the opening 118 are aligned for engaging a complementary pair of dimples 115*b*, 115*b* on the sidewall 122 on the opposing clamshell portion 120 near the recess 125 to secure the cutting tool 500 between the sidewalls 112 and 122. The overlapping edges of the planar base 520 of the cutting tool 500 prevents the cutting tool 500 from being pulled through the opening 118 in the clamshell portion 110. Similarly, the planar base 520 being seated in the recess 125 prevents the housing 510 of the cutting tool 500 from being pulled through the opening 118. As a result, the cutting tool 500 is securely attached to the package 100 when the clamshell portions 110 and 120 are in the secured or closed configuration. Additional details of the cutting tool 500 being sandwiched between the sidewalls 112 and 122 may be seen in FIG. 4.

Figure 5:
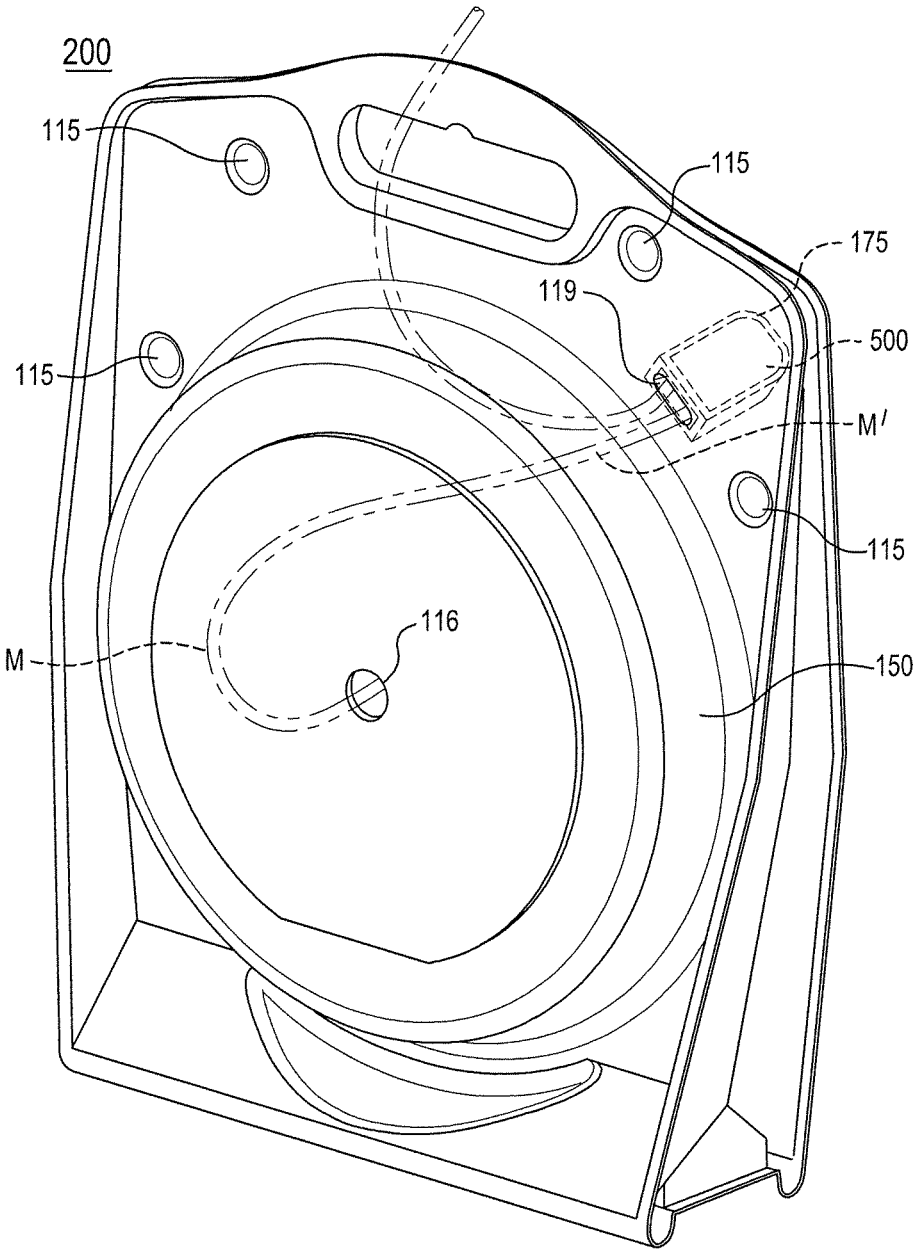
FIG. 5 is a perspective view of another embodiment of a package for monofilament line having an embedded cutting tool installed in a pocket formed in a clamshell portion partially forming the package.
Figure 6:
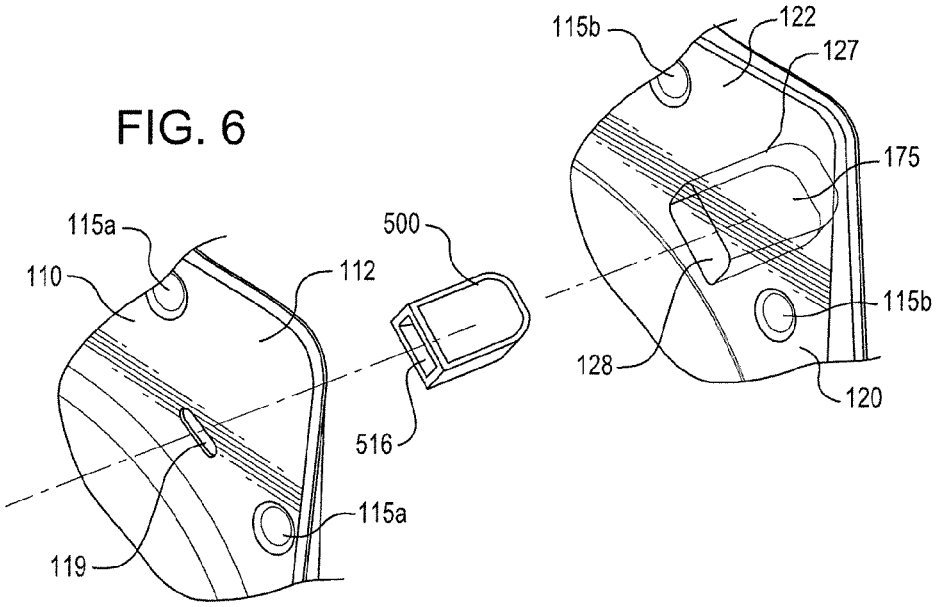
FIG. 6 is an exploded perspective view of partial cutaway portions of two clamshell portions that form the package of FIG. 5 and the cutting tool exploded from the pocket formed in one of the clamshell portions.
Figure 7:
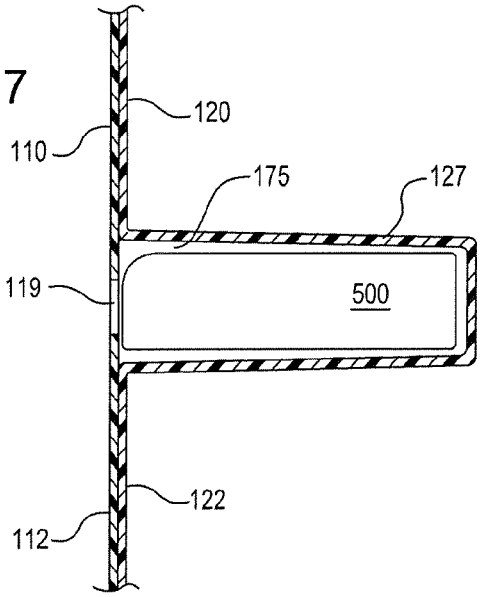
FIG. 7 is a side view of a cutaway cross-section of a portion of the package of FIG. 6 in the vicinity of the cutting tool showing the cutting tool installed in the pocket formed in one of the clamshell portions.
Figure 11:
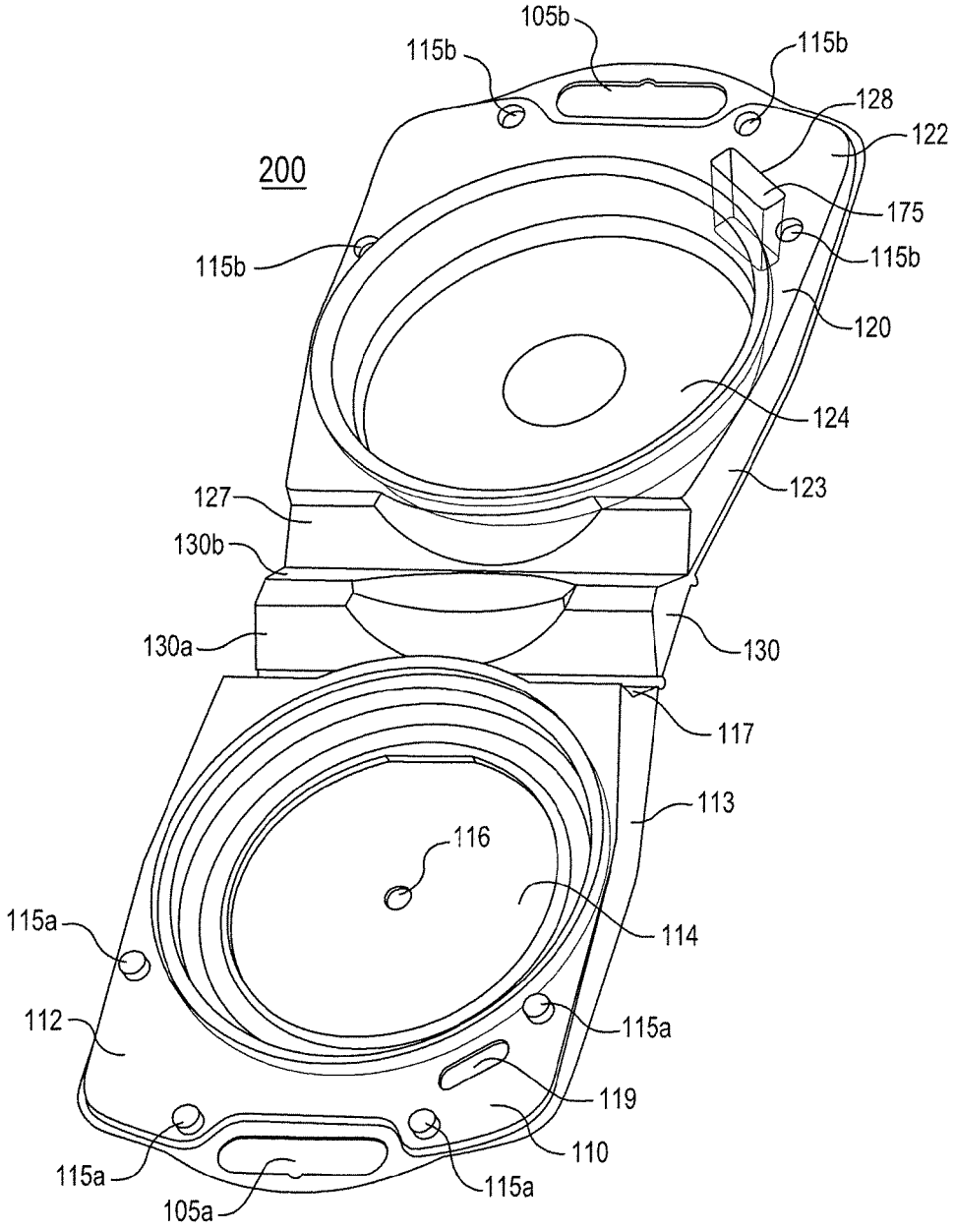
FIG. 11 is an exploded perspective view of the package of FIG. 5 with two clamshell portions in an open or unsealed configuration, shown without the cutter 500.

Referring now to FIGS. 5-7 and again FIG. 11, shown is another embodiment of a package 200 having the cutting tool 500 embedded in an integrally formed pocket 175 in the clamshell portion 120 of the package 200 such that the cutting tool 500 is entirely contained within the interior of the package 200. In this embodiment, the cutter 500 shown in FIGS. 6 and 7 is identical to the cutter in FIG. 2 except without the flange 522. A segment of the monofilament line M may be cut from the spool (not shown) contained in the cavity 150 by passing a looped portion M' of the monofilament line M through a slit 119 in the clamshell portion 110 and the opening 516 into the cavity 515 of the cutting tool 500. The monofilament line M may be dispensed from the cavity 150 through an opening 116 in the recess 114 of the clamshell portion 110. The portion of the monofilament line M' is urged against the cutting blade 518 in the cavity 515 thereby cutting the portion of the monofilament line M' from the spool (not shown). The cut ends of the portion of the monofilament line M' may now be removed from the cavity 515 through the opening 516 and the slit 119 in the clamshell portion 110 of package 200.

The cutting tool 500 is inserted into the pocket 175 in the clamshell portion 120 through an opening 128 in the sidewall 122. The pocket 175 is integrally formed by thermoforming or other means in a sidewall 127 that is sized and shaped to receive the cutting tool 500. The sidewall 127 may project outwardly from the outer side of the sidewall 122 of the clamshell portion 120. The pocket 175 may be integrally formed in the sidewall 122 by any known means such as thermoforming, formed as a separate component and attached thereon or other means. The cutting tool 500 is secured in the pocket 175 when the clamshell portions 110 and 120 are in the sealed or closed configuration using the snap-type fasteners 115 in the vicinity of the pocket 175. The projections 115*a* in the clamshell portion 110 snap fit into the dimples 115*b* in the clamshell portion 120 to seal the clamshell portions 110 and 120 together. When the clamshell portions 110 and 120 are sealed together, the slit 119 in the clamshell portion 110 is aligned with the opening 516 into the cavity 515 of the cutting tool 500. The portions of clamshell 110 overlapping the cutting tool 500 around the opening 516 prevent the cutting tool 500 from exiting the pocket 175.

Figure 8:
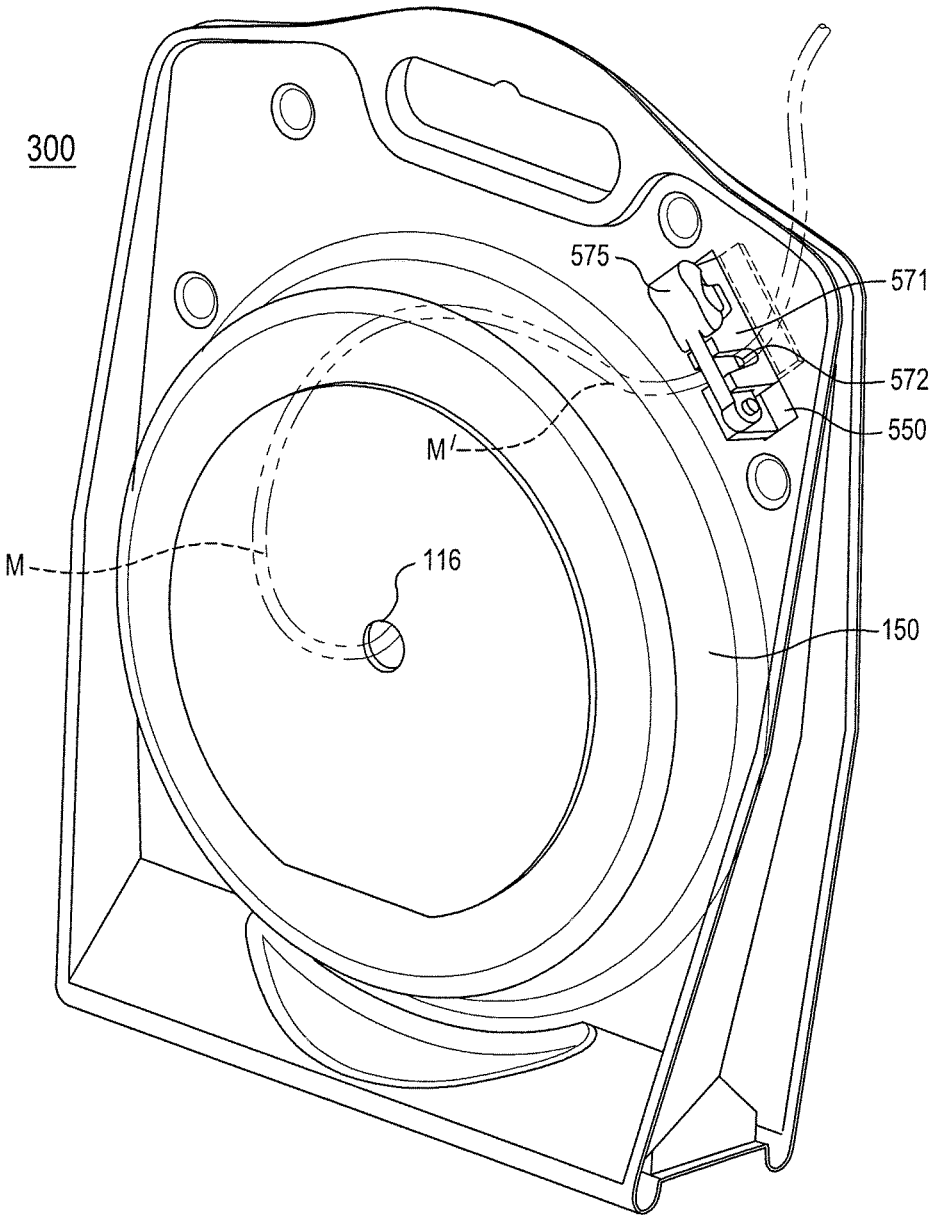
FIG. 8 is a perspective view of another embodiment of a package for monofilament line having an embedded cutting tool.
Figure 9:
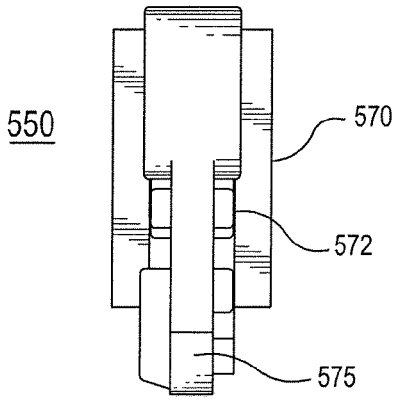
FIG. 9 is a front view of the cutting tool of FIG. 8.
Figure 10:
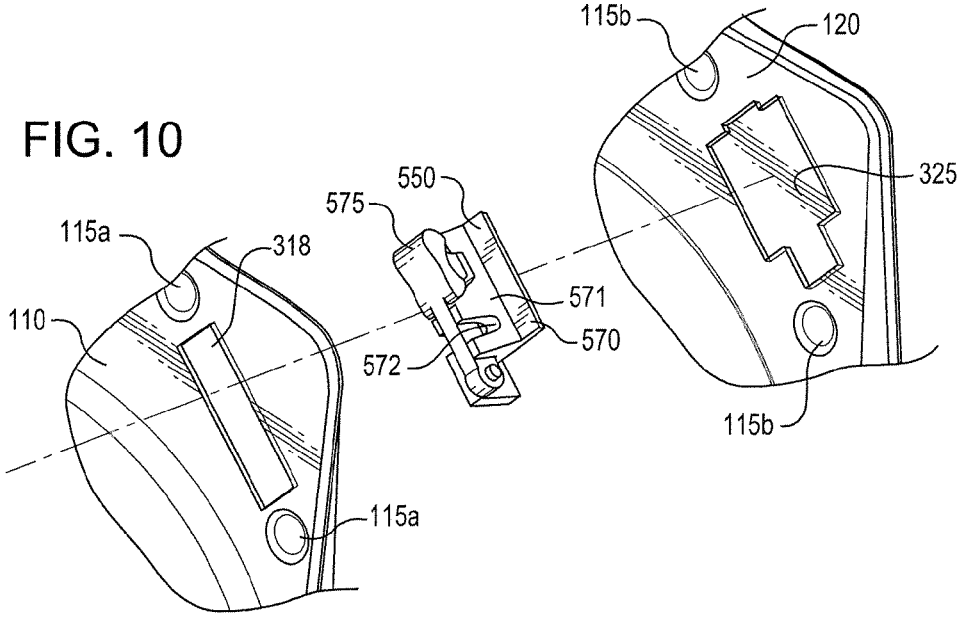
FIG. 10 is an exploded perspective view of partial cutaway portions of two clamshell portions that form the package of FIG. 8 and the cutting tool embedded between clamshell portions forming the package.

Referring now to FIGS. 8-10 and again FIG. 11, shown is another embodiment of a package 300 having a cutting tool 550 embedded in at least a portion of the package 300. A segment of the monofilament line M may be cut from the spool (not shown) contained in the cavity 150 by inserting a portion of the monofilament line M' into a slot 572 in the cutting tool 550 and urging a lever 575 against the monofilament line M' to urge the monofilament line M' into a cutting blade (not shown) in the slot 572. The monofilament line M may be dispensed from the cavity 150 through an opening 116 in the recess 114 of the clamshell portion 110. A more detailed description of the cutting tool 550 and its operation may be found in U.S. Pat. No. 7,908,953, which is hereby incorporated by reference as if fully rewritten herein.

In an embodiment, the cutting tool 550 is mounted to the package 300 by being partially sandwiched between the sidewall 112 of the clamshell portion 110 and the sidewall 122 of the clamshell portion 120. The housing 571 of the cutting tool 550 is inserted through an opening 318 in sidewall 112 for securing the cutting tool 550 to the sidewall 512 while allowing the housing 571 to be exposed on the exterior of the sidewall 112. The opposing clamshell portion 120 has a recess 325 formed in the sidewall 122 sized and shaped to receive the base 570 of the cutting tool 550 when the opposing clamshell portions 110 and 120 are in the sealed or closed configuration shown in FIG. 1. An adhesive may be used to facilitate adhering the base 570 to the recess 325. A pair of projections 115*a*, 115*a* on sidewall 112 of the clamshell portion 110 near the opening 318 are aligned for engaging a complementary pair of dimples 115*b*, 115*b* on the sidewall 122 on the opposing clamshell portion 120 near the recess 325 to secure the cutting tool 550 between the sidewalls 112 and 122. The overlapping edges of the planar base 570 of the cutting tool 550 prevents the cutting tool 550 from being pulled through the opening 318 in the clamshell portion 110. Similarly, the planar base 570 being seated in the recess 325 prevents the housing 572 of the cutting tool 550 from being pulled back through the opening 318. As a result, the cutting tool 550 is securely attached to the package 300 when the clamshell portions 110 and 120 are in the secured or closed configuration.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A device for storing a roll of monofilament line and dispensing a length of monofilament line in combination with a cutting tool embedded in the device for cutting the length of monofilament line from the roll, comprising:

a package formed from two opposing clamshell portions made from sheets of film;

a recess formed in each of the clamshell portions that collectively form a chamber when said two clamshell portions are in a closed configuration, said chamber configured to store said roll and allow a length of monofilament line to unwind from the roll during dispensing;

a cutting tool at least partially disposed between the two clamshell portions when in the closed configuration configured to attach the cutting tool to the package, wherein at least a portion of the cutting tool is accessible from outside of the package for cutting a length of monofilament line being dispensed from the package; and the cutting tool comprising a base portion sandwiched between the two clamshell portions when in the closed configuration and a body portion that protrudes through an opening in one of the clamshell portions such that a cavity formed by the body portion is exterior to the package, and wherein a looped portion of the monofilament line is inserted into the cavity such that an outside edge of the loop presses against a blade in the cavity to cut the length of the monofilament line being dispensed form the roll in the chamber of the package.

2. The package and cutting tool combination of claim 1, further comprising a depression in the clamshell portion opposed from the clamshell portion having the opening wherein the body portion of the cutting device protrudes, said depression sized and shaped to receive the base portion.

* * * * *